US012768252B2

(12) United States Patent
Fields et al.

(10) Patent No.: US 12,768,252 B2
(45) Date of Patent: Oct. 20, 2026

(54) SUBSEA FLUID TRANSFER SYSTEM AND PROCESS FOR USING THE SAME

(71) Applicant: Koil Energy Solutions, Inc., Houston, TX (US)

(72) Inventors: Michael Shane Fields, Conroe, TX (US); Stanley O'Neil Stuckey, Jr., Cleveland, TX (US); Troy Moran, Houston, TX (US); Christopher Lee Sebesta, Houston, TX (US)

(73) Assignee: KOIL ENERGY SOLUTIONS, INC., Houston, TX (US)

( * ) Notice: Subject to any disclaimer, the term of this patent is extended or adjusted under 35 U.S.C. 154(b) by 0 days.

(21) Appl. No.: 19/424,397

(22) Filed: Dec. 18, 2025

(65) Prior Publication Data

US 2026/0176938 A1 Jun. 25, 2026

Related U.S. Application Data

(60) Provisional application No. 63/737,967, filed on Dec. 23, 2024.

(51) Int. Cl.
*E21B 43/013* (2006.01)
*E21B 43/017* (2006.01)

(52) U.S. Cl.
CPC ..... *E21B 43/013* (2013.01); *E21B 43/017* (2013.01)

(58) Field of Classification Search
CPC ..... E21B 43/013; E21B 17/017; E21B 33/038
See application file for complete search history.

(56) References Cited

U.S. PATENT DOCUMENTS 7,318,479 B2 * 1/2008 Williams ..... E21B 23/006 166/341
7,467,662 B2 * 12/2008 Smith ..... H01R 13/6315 166/344

(Continued)

FOREIGN PATENT DOCUMENTS

DE 202008002786 U1 7/2009
KR 100603545 B1 7/2006

OTHER PUBLICATIONS

Extended European Search Report for Corresponding Application No. 25226359.5 dated Apr. 29, 2026.

(Continued)

*Primary Examiner* — Carib A Oquendo
(74) *Attorney, Agent, or Firm* — Edmmds & Cmaidalka, P.C.

(57) ABSTRACT

Subsea fluid transfer systems and process for using same. The subsea fluid transfer system can include first and second end termination assemblies, a plurality of fluid transfer conduits, and a plurality of separator assemblies. The first and second end termination assemblies can each include a mechanical connector first part, a fluid coupler first part, and a fluid header conduit in fluid communication with the fluid coupler first part. The plurality of fluid transfer conduits can be in fluid communication with the fluid header conduit of the first and second end termination assemblies. Each separator assembly can define a plurality of conduit bores therethrough and each fluid transfer conduit can be disposed within a corresponding conduit bore defined each separator assembly. The plurality of separator assemblies can be distributed along a length of the plurality of fluid transfer conduits and configured to maintain a separation distance between adjacent fluid transfer conduits.

23 Claims, 4 Drawing Sheets

(56) References Cited

U.S. PATENT DOCUMENTS

| | | | | |
|---|---|---|---|---|
| 8,100,182 | B2 * | 1/2012 | Smith | E21B 43/013 166/344 |
| 8,186,910 | B2 | 5/2012 | Smith | |
| 10,711,578 | B2 * | 7/2020 | Rutherford | E21B 43/013 |
| 2005/0045776 | A1 | 3/2005 | Yudis et al. | |
| 2010/0059229 | A1 | 3/2010 | Smith et al. | |
| 2012/0304447 | A1 * | 12/2012 | Smith | F16L 1/123 29/434 |
| 2016/0076684 | A1 * | 3/2016 | Coutts | F16L 11/085 285/261 |
| 2017/0350209 | A1 * | 12/2017 | Hestetun | H01R 13/523 |
| 2019/0360313 | A1 * | 11/2019 | Ellingsen | E21B 43/013 |
| 2022/0275693 | A1 | 9/2022 | Plenderleith | |

OTHER PUBLICATIONS

Extended European Search Report for Application No. 25226348.8 dated Apr. 29, 2026.

* cited by examiner 150
150
150

SUBSEA FLUID TRANSFER SYSTEM AND PROCESS FOR USING THE SAME

CROSS-REFERENCE TO RELATED APPLICATION

This application claims priority to U.S. Provisional Patent Application No. 63/737,967, filed on Dec. 23, 2024, which is incorporated by reference herein.

FIELD

Embodiments described generally relate to subsea fluid transfer systems and processes for using same. More particularly, such embodiments relate to systems configured to transfer fluid from a first subsea structure to a second subsea structure and processes for using same.

BACKGROUND

In the offshore oil and gas industry, and particularly the subsea oil and gas industry, one or more fluids are often transferred between a first subsea structure and a second subsea structure using a rigid or flexible fluid transfer conduit. It is common practice to insulate fluid transfer conduits to maintain a temperature of the fluid flow therethrough above a predetermined minimum temperature. Recently, however, it has become desirable to cool the fluid while the fluid is transferred between the first subsea structure and the second subsea structure.

There is a need, therefore, for improved subsea fluid transfer systems and processes for using same.

SUMMARY

Subsea fluid transfer systems and processes for using the same are provided. In some embodiments, the subsea fluid transfer system can include a first end termination assembly and a second end termination assembly each can include a mechanical connector first part, a fluid coupler first part; and a fluid header conduit in fluid communication with the fluid coupler first part. In some embodiments, the subsea fluid transfer system can include a plurality of fluid transfer conduits each having a first end and a second end. The first end of each fluid transfer conduit can be in fluid communication with the fluid header conduit of the first end termination assembly, and the second end of each fluid transfer conduit can be in fluid communication with the fluid header conduit of the second end termination assembly. The subsea fluid transfer system can include a plurality of separator assemblies. Each separator assembly can define a plurality of conduit bores therethrough, and each fluid transfer conduit can be disposed within a corresponding conduit bore. The plurality of separator assemblies can be distributed along a length of the plurality of fluid transfer conduits and can maintain a separation distance between adjacent fluid transfer conduits.

In some embodiments, a process for transferring a fluid between a first subsea structure and a second subsea structure is provided. The process for transferring a fluid between a first subsea structure and a second subsea structure and can include deploying a subsea fluid transfer system toward a seabed of a body of water. The subsea fluid transfer system can include a first end termination assembly and a second end termination assembly each can include a mechanical connector first part, a fluid coupler first part, and a fluid header conduit that can be in fluid communication with the fluid coupler first part. In some embodiments, the subsea fluid transfer system can include a plurality of fluid transfer conduits each having a first end and a second end. The first end of each fluid transfer conduit can be in fluid communication with the fluid header conduit of the first end termination assembly, and the second end of each fluid transfer conduit can be in fluid communication with the fluid header conduit of the second end termination assembly. The subsea fluid transfer system can include a plurality of separator assemblies, each separator assembly can define a plurality of conduit bores therethrough, and each fluid transfer conduit can be disposed within a corresponding conduit bore. The plurality of separator assemblies can be distributed along a length of the plurality of fluid transfer conduits and can maintain a separation distance between adjacent fluid transfer conduits. The process can include connecting the mechanical connector first part of the first end termination assembly to a mechanical connector second part disposed on the first subsea structure such that the fluid coupler first part of the first end termination assembly can be in fluid communication with the fluid coupler second part disposed on the first subsea structure and connecting the mechanical connector first part of the second end termination assembly to a mechanical connector second part disposed on the second subsea structure such that the fluid coupler first part of the second end termination assembly can be in fluid communication with the fluid coupler second part disposed on the second subsea structure.

In some embodiments, the subsea fluid transfer system can include a first end termination assembly and a second end termination assembly, each can include a mechanical connector first part, a fluid coupler first part, and a fluid header conduit that can be in fluid communication with the fluid coupler first part. The subsea fluid transfer system can include a plurality of fluid transfer conduits each having a first end and a second end. The first end of each fluid transfer conduit can be in fluid communication with the fluid header conduit of the first end termination assembly, and the second end of each fluid transfer conduit can be in fluid communication with the fluid header conduit of the second end termination assembly. The subsea fluid transfer system can include a plurality of separator assemblies, each separator assembly can define a plurality of conduit bores therethrough, and each fluid transfer conduit can be disposed within a corresponding conduit bore. The subsea fluid transfer system can include a plurality of elevator modules, each elevator module can be disposed about a corresponding separator assembly. The subsea fluid transfer system can include a first bend restrictor assembly that can be connected to the first end termination assembly and can be configured to limit a curvature of a portion of the plurality of fluid transfer conduits to within a specified allowable limit; and a second bend restrictor assembly that can be connected to the second end termination assembly that can be configured to limit a curvature of a portion of the plurality of fluid transfer conduits to within a specified allowable limit. The mechanical connector first part of the first end termination assembly can be configured to connect to a corresponding mechanical connector second part disposed on a first subsea structure. The mechanical connector first part of the second end termination assembly can be configured to connect to a corresponding mechanical connector second part disposed on a second subsea structure. The fluid coupler first part of the first end termination assembly can be configured to fluidly connect to a corresponding fluid coupler second part disposed on the first subsea structure. The fluid coupler first part of the second end termination assembly can be configured to fluidly connect to a corresponding fluid coupler second part disposed on the second subsea structure. The plurality of separator assemblies can be distributed along a length of the plurality of fluid transfer conduits and can be configured to maintain a separation distance between adjacent fluid transfer conduits. The plurality of elevator modules can be configured to maintain the plurality of fluid transfer conduits at an elevation above a seabed.

BRIEF DESCRIPTION OF THE DRAWINGS

The various aspects and advantages of the preferred embodiment(s) of the present invention will become apparent to those skilled in the art upon an understanding of the following detailed description of the invention, read in light of the accompanying drawings which are made a part of this specification.

DETAILED DESCRIPTION

Figure 1:
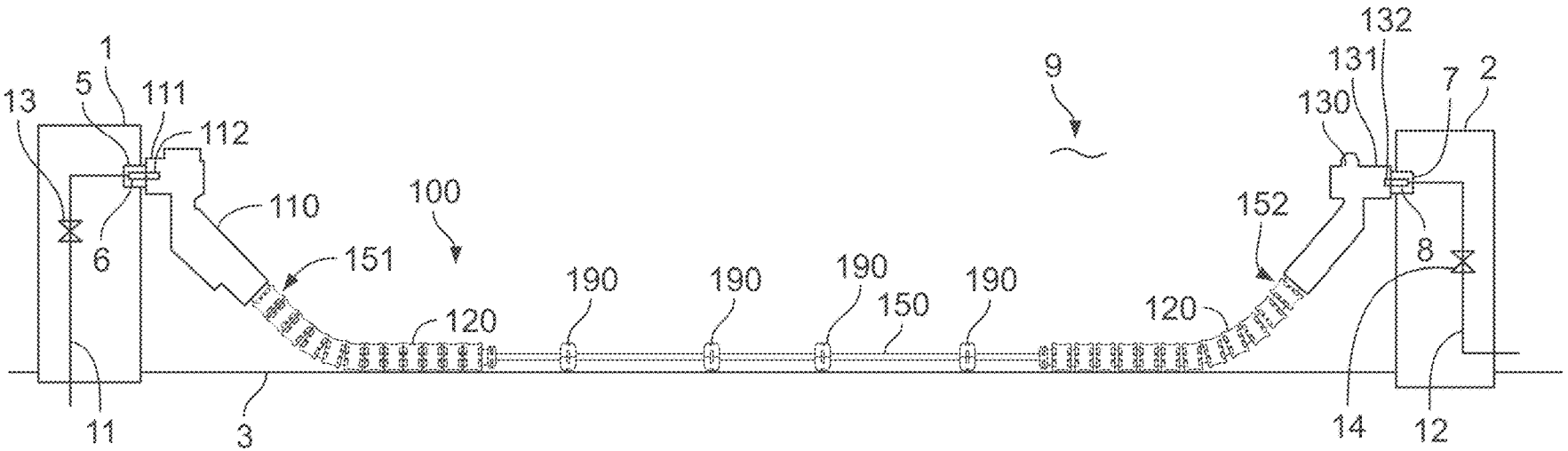
FIG. 1 depicts a side elevation view of an illustrative subsea fluid transfer system that includes a plurality of fluid transfer conduits, according to one or more embodiments described.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and methods of using the same may be equally effective at various angles or orientations.

Figure 2:
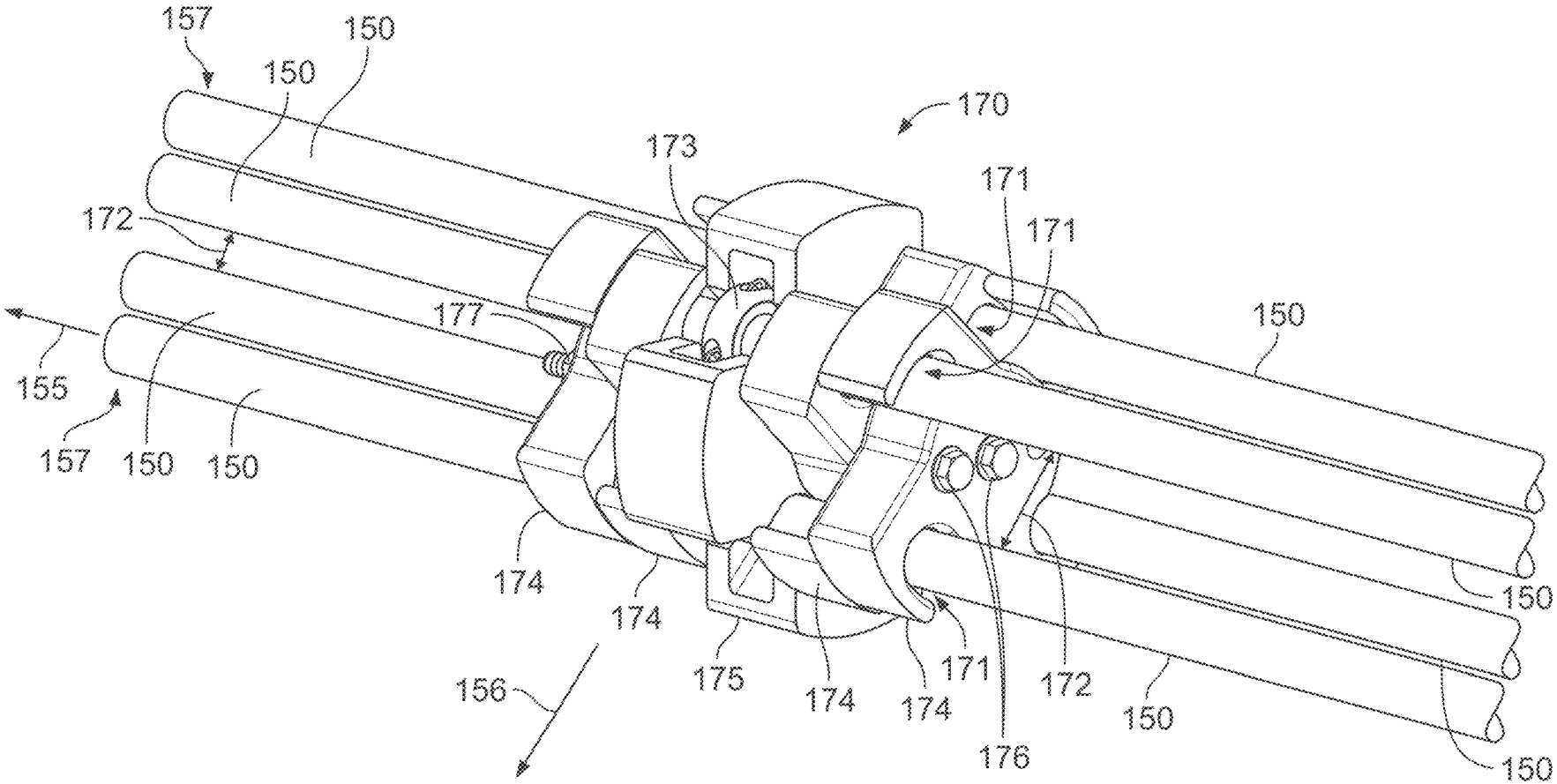
FIG. 2 depicts a perspective view of a portion of the plurality of fluid transfer conduits shown in FIG. 1 that is disposed within an illustrative separator assembly, according to one or more embodiments described.
Figure 3:
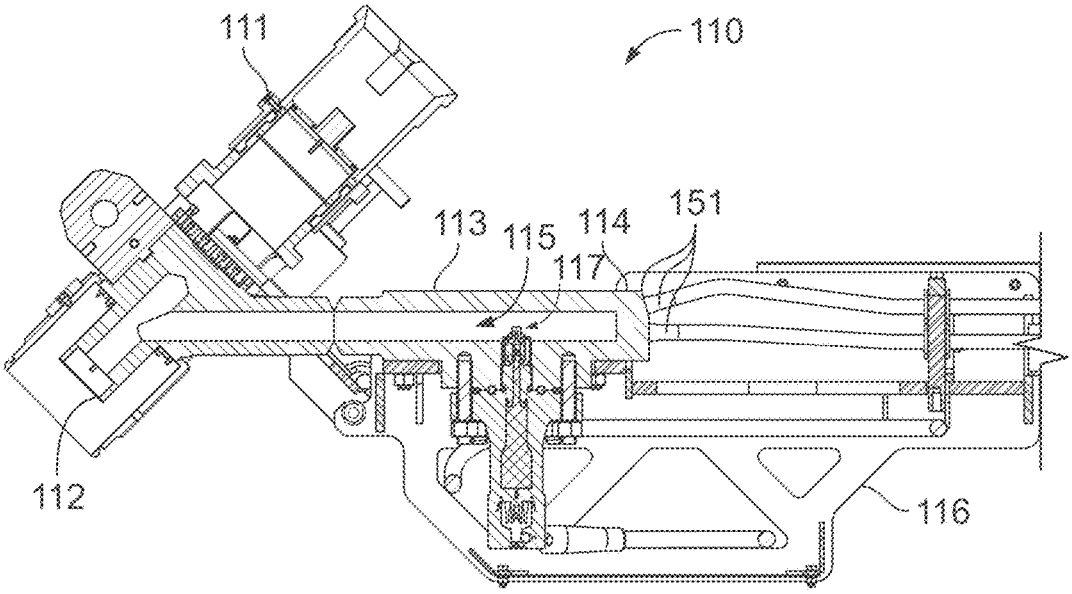
FIG. 3 depicts a cross-sectional view of an illustrative first end termination assembly of a subsea fluid transfer system, according to one or more embodiments described.
Figure 4:
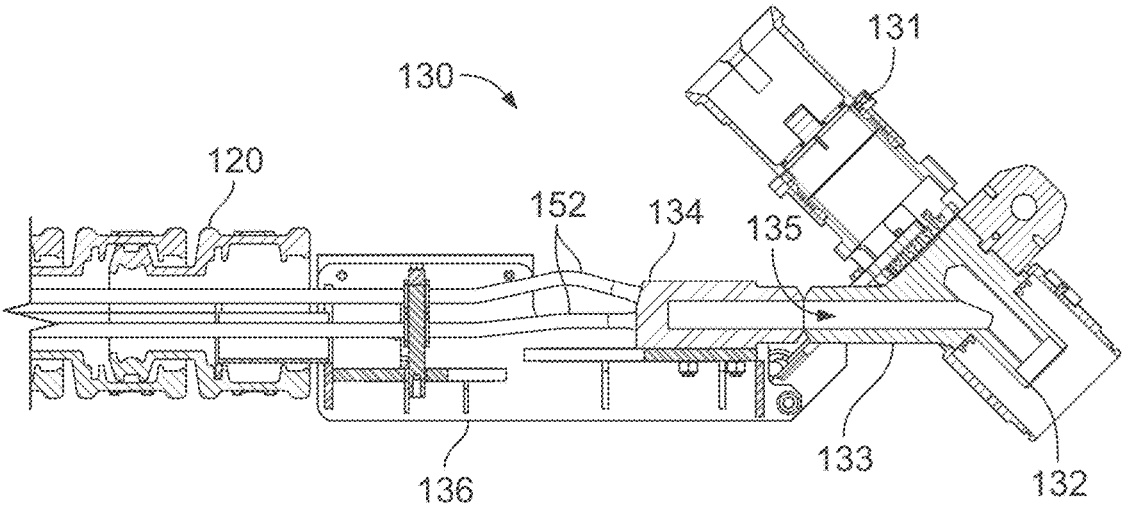
FIG. 4 depicts a cross-sectional view of an illustrative second end termination assembly of a subsea fluid transfer system, according to one or more embodiments described.

FIG. 1 depicts a side elevation view of an illustrative subsea fluid transfer system 100 that includes a plurality of fluid transfer conduits 150, according to one or more embodiments. In some embodiments, the subsea fluid transfer system 100 can be disposed between a first subsea structure 1 and a second subsea structure 2. In some embodiments, the first subsea structure 1 and/or the second subsea structure 2 can be disposed on a seabed 3 of a body of water 9. FIG. 2 depicts a perspective view of a portion of the plurality of fluid transfer conduits 150 of the subsea fluid transfer system 100 disposed within an illustrative separator assembly 170, according to one or more embodiments. In some embodiments, the subsea fluid transfer system 100 can include a first end termination assembly 110, a second end termination assembly 130, the plurality of fluid transfer conduits 150, a plurality of the separator assemblies 170 (see FIGS. 2 and 5), an optional bend restrictor assembly 120 (two are shown in FIG. 1), and one or more optional elevator modules 190 (a plurality is shown in FIG. 1). The optional elevator modules 190 can be disposed about a corresponding separator assembly 170. FIG. 3 depicts a cross-sectional view of an illustrative first end termination assembly 110 of the subsea fluid transfer system 100 and FIG. 4 depicts a cross-sectional view of an illustrative second end termination assembly 130 of the subsea fluid transfer system 100 shown in FIG. 1, according to one or more embodiments.

With regard to the fluid transfer conduits 150, the fluid transfer conduits 150 can be configured to transfer one or more hydrocarbons, e.g. natural gas or a produced well fluid, water, air, carbon dioxide, an alcohol, e.g. methanol or any mixture thereof. In some embodiments, the subsea fluid transfer system 100 can be configured to provide a fluid connection, an electrical connection, and/or an optical connection via the one or more transfer conduits 150. As such, in some embodiments, the fluid transfer system 100 can be configured to connect fluid conduits, electrical cables, and/or fiber optic cables 150. For simplicity and ease of description, the fluid transfer system 100 is further described as being configured to transfer a fluid via the fluid transfer conduits 150. It should be understood, however, in some embodiments, one or more of the fluid transfer conduits 150 can be configured to transfer electricity and/or electromagnetic radiation, e.g., light, rather than a fluid.

Referring to FIGS. 1-4 collectively, in some embodiments, the first end termination assembly 110 can include a structural frame 116, a mechanical connector first part 111, a fluid coupler first part 112, a fluid header conduit 113, and a manifold 114. In some embodiments, the mechanical connector first part 111, the fluid coupler first part 112, the fluid header conduit 113, and the manifold 114 can be mounted or otherwise disposed on the structural frame 116. In some embodiments, the structural frame 116 can be a steel or other structure that can support internal and external loads acting the mechanical connector first part 111, the fluid coupler first part 112, the fluid header conduit 113, and the manifold 114.

In some embodiments, the mechanical connector first part 111 can be configured to connect to a corresponding mechanical connector second part 5 disposed on the first subsea structure 1 to secure the first end termination assembly 110 to the first subsea structure 1. In some embodiments, the fluid header conduit 113 can be in fluid communication with the fluid coupler first part 112. In some embodiments, the fluid coupler first part 112 can be configured to fluidly connect to a corresponding fluid coupler second part 6 disposed on the first subsea structure 1 to establish fluid communication between the fluid header conduit 113 and a fluid transfer conduit 11 disposed on the first subsea structure 1.

In some embodiments, the second end termination assembly 130 can include a structural frame 136, a mechanical connector first part 131, a fluid coupler first part 132, a fluid header conduit 133, and a manifold 134. In some embodiments, a mechanical connector first part 131, the fluid coupler first part 132, the fluid header conduit 133, and the fluid manifold 134 can be mounted onto the structural frame 136. In some embodiments, the structural frame 136 can be a steel or other structure that can support internal and external loads acting on the mechanical connector first part 131, the fluid coupler first part 132, the fluid header conduit 133, and the manifold 134.

In some embodiments, the mechanical connector first part 131 can be configured to connect to a corresponding mechanical connector second part 7 disposed on the second subsea structure 2 to secure the second end termination assembly 130 to the second subsea structure 2. In some embodiments, the fluid header conduit 133 can be in fluid communication with fluid coupler first part 132. In some embodiments, the fluid coupler first part 131 can be configured to fluidly connect to a corresponding fluid coupler second part 8 disposed on the second subsea structure 2 to establish fluid communication between the fluid header conduit 133 and a fluid transfer conduit disposed 12 on the second subsea structure 2. In some embodiments, the first subsea structure 1 can be a subsea Christmas tree and the second subsea structure 2 can be a subsea manifold or a subsea pipeline end termination.

In some embodiments, the mechanical connector first part 111 and the mechanical connector first part 131 can each be a MORAY® Termination System available from Koil Energy Solutions. In some embodiments, the first end termination assembly 110 and the second end termination assembly 130 can be configured to be installed on the first and second subsea structures 1, 2 respectively with a Remote Operated Vehicle (ROV) fitted with a Flying Lead Orientation Tool (FLOT). In some embodiments, the first and second end termination assemblies 110, 130 can be fitted with a clump weight and a buoyancy module (not shown) to facilitate connection of the first and second end termination assemblies 110, 130 to the first and second subsea structures 1, 2 respectively.

In some embodiments, the subsea fluid transfer system 100 can include one or more of the fluid transfer conduits 150. In some embodiments, the subsea fluid transfer system 100 can include one fluid transfer conduit 150, two fluid transfer conduits 150, three fluid transfer conduits 150, four fluid transfer conduits 150, between five and ten fluid transfer conduits 150, between 11 and 12 fluid transfer conduits 150, or even more than 12 fluid transfer conduits 150. Each fluid transfer conduit 150 can have a first end 151 and a second end 152. In some embodiments, the first end 151 of each fluid transfer conduit 150 can be in fluid communication with the fluid header conduit 113 of the first end termination assembly 110 and the second end 152 of each fluid transfer conduit 150 can be in fluid communication with the fluid header conduit 133 of the second end termination assembly 130. In some embodiments, the fluid coupler first part 112, the fluid header conduit 113, the fluid coupler first part 132, the fluid header conduit 133, the fluid coupler first part 132, and the plurality of fluid transfer conduits 150 can be in fluid communication with one another and can be configured to be in fluid communication with the fluid coupler second part 6 and the fluid coupler second part 8 and can be configured to flow a fluid between the fluid conduit 11 disposed on the first subsea structure 1 and the fluid transfer conduit 12 disposed on the second subsea structure 2. In some embodiments, the fluid header conduit 113 of the first end termination assembly 110 and the fluid header conduit 133 of the second end termination assembly 130 can be a metallic tubular member, a composite tubular member, a thermoplastic tubular member, a pipe, or a steel, e.g., stainless-steel, tube. In some embodiments, the fluid header conduit 113 of the first end termination assembly 110 can be an integral part of the first end termination assembly 110 that can define a bore 115 therethrough. In some embodiments, the fluid header conduit 133 of the second end termination assembly 130 can be an integral part of the second end termination assembly 110 that can define a bore 135 therethrough. In some embodiments, each fluid transfer conduit 150 can independently be a metallic tubular member, a composite tubular member, a thermoplastic tubular member, a pipe, or a steel, e.g., stainless-steel, tube. In other embodiments, each fluid transfer conduit 150 can independently be can be a tubular member, an electric cable, or a fiber optical cable. In some embodiments, the fiber optical cable can be configured to transfer electromagnetic radiation, e.g., light, therethrough.

In some embodiments, as noted above, the first end termination assembly 110 and the second end termination assembly 130 can each include a manifold 114, 134. In some embodiments, the first end 151 of each fluid transfer conduit 150 can be in fluid communication with the fluid header conduit 113 via the manifold 114 of the first end termination assembly 110 and the second end 152 of each fluid transfer conduit 150 can be in fluid communication with the fluid header conduit 133 via the manifold 134 of the second end termination assembly 130. In some embodiments, the fluid coupler first part 111, the fluid header conduit 113, the manifold 114, the fluid coupler first part 131, the fluid header conduit 133, the manifold 134, and the fluid transfer conduit(s) 150 can be in fluid communication with one another and can be configured to be in fluid communication with the fluid coupler second part 6 and the fluid coupler second part 8 and can be configured to flow a fluid between the fluid transfer conduit 11 of the first subsea structure 1 and the fluid transfer conduit 12 of the second subsea structure 2. Referring to FIG. 3, in some embodiments, the first end termination assembly 110 can include at least one injection port 117. In some other embodiments, the second end termination assembly 130 can include at least one injection port, not shown. In some embodiments, the at least one injection port 117 can be configured to inject a fluid, for example a chemical into the fluid header conduit 113.

As shown in FIG. 2, in some embodiments, the subsea fluid transfer system 100 (see FIG. 1) can include at least one separator assembly 170. In some embodiments the separator assembly 170 can define a plurality of conduit bores 171 therethrough. In some embodiments, the quantity or number of separator assemblies 170 can depend, at least in part, on a length of fluid transfer conduits 150 and/or the size and/or type of fluid transfer conduits 150. In some embodiments, the plurality of separator assemblies 170 can be equally distributed along a length of the fluid transfer conduits 150. In other embodiments, the subsea separator assemblies 170 can be unevenly distributed along the length of the fluid transfer conduits 150.

As shown in FIGS. 1 and 2, the plurality of fluid transfer conduit 150 can be configured to be in direct contact with the body of water 9. For example, the subsea fluid transfer system 100 can be configured as an "unbundled" or a loose tube flying lead assembly as disclosed in U.S. Pat. No. 8,100,182. In such embodiments, the plurality of fluid transfer conduits can be free from an outer sheath such that at least a portion of each fluid conduit 150 can be in direct contact with the body of water 9 to more efficiently promote heat transfer from a fluid flowing through or otherwise disposed within each fluid conduit 150 to the body of water 9. The one or more separator assemblies 170 can be disposed about the fluid conduit(s) 150 such that the portion of the fluid conduit(s) 150 about which the separator assembly 170 can be disposed can be covered or otherwise protected or at least partially protected from being in direct contact with the body of water 9.

In some embodiments, each of the plurality of bores 171 can be through bores and can be parallel or substantially parallel with respect to one another. In some embodiments, the plurality of bores 171 can be positioned within each separator assembly 170 such that a plurality of fluid transfer conduits 150 can be separated from one another. Said another way, the fluid transfer conduits 150 in the plurality of fluid transfer conduits 150 can be spaced apart from or otherwise not in contact with one another. In some embodiments, the separator assembly 170 can be configured to maintain a separation distance 172 (see FIG. 2) between adjacent fluid transfer conduits 150. In some embodiments, the separation distance 172 between adjacent fluid transfer conduits 150 can be selected to facilitate a cooling of the fluid as the fluid flows through the fluid transfer conduits 150. In some embodiments the fluid transfer system 100 can transfer heat from the fluid through a wall or sidewall 157 of each fluid transfer conduit 150 to the body of water 9. In some embodiments, the fluid can be cooled via convection heat transfer when the fluid is transferred between the first subsea structure 1 to the second subsea structure 2.

In some embodiments, each fluid transfer conduit 150 can be disposed within a corresponding conduit bore 171 of the separator assembly 170. In some embodiments, an internal diameter of each conduit bore 171 can be greater than an outer diameter of each corresponding fluid transfer conduit 150. In other embodiments, the internal diameter of each conduit bore 171 can be the same or substantially the same, e.g., within 10%, or +5%, 3%, or 1%, of the outer diameter of each corresponding fluid transfer conduit 150.

In some embodiments, each separator assembly 170 can be configured such that at least a portion of the fluid transfer conduits 150 can move along a longitudinal direction 155 of the fluid transfer conduit 150 relative to the separator assembly 170. In some embodiments, each separator assembly 170 can be configured such that at least one of the fluid transfer conduits 150 can be secured to the separator assembly 170 in a manner that inhibits or prevents the at least one of the fluid transfer conduits 150 from moving along the longitudinal direction 155 of the fluid transfer conduit 150 relative to the separator assembly 170. In some embodiments, the separator assembly 170 can include a plurality of separator subparts 174, 175, five are shown, i.e., one separator subpart 175 and four separator subparts 174 are shown. In some embodiments, the separator assembly 170 can include a clamp or tube clamp 173 that can be connected to at least one of the fluid transfer conduits 150. In some embodiments, the separator subpart 175 can be configured to be disposed about the tube clamp 173 such that the separator subpart 175 can be restrained in the longitudinal direction 155 of the fluid transfer conduits 150 relative to the tube clamp 173. In some embodiments, at least some of the separator subparts 174 and 175 can be identical to one another. In other embodiments, the separator subparts 174 can be dissimilar with respect to one another. For example, two different separator subparts 174, 175 are shown.

In some embodiments, the separator subparts 174 and 175 can be held together via at least one fastener 176, two are shown. More particularly, in some embodiments as shown, the fastener 176 can be a bolt having a threaded end configured to threadingly engage with a nut 177 to secure the fastener 176 to the separator subparts 174 and 175. Each nut 177 can be tightened to secure the separator subparts 174 and 175 together.

In some embodiments, the separator assembly 170 can be configured such that each fluid transfer conduit 150 can be substantially constrained relative to each separator assembly 170 in a direction 156 that is normal or perpendicular to the longitudinal direction 155, or said another way, each fluid transfer conduit 150 can be substantially constrained relative to each separator assembly 170 in a radial direction. In some embodiments, each separator assembly 170 can be configured to maintain adjacent fluid transfer conduits 150 separated from each other by the separation distance 172. In some embodiments, as described above, the separation distance 172 between adjacent pairs of fluid transfer conduits 150 can be substantially equal to one another, in other embodiments, the separation distances 172 between differing adjacent pairs of fluid transfer conduits 150 can be substantially different from one another.

Figure 6:
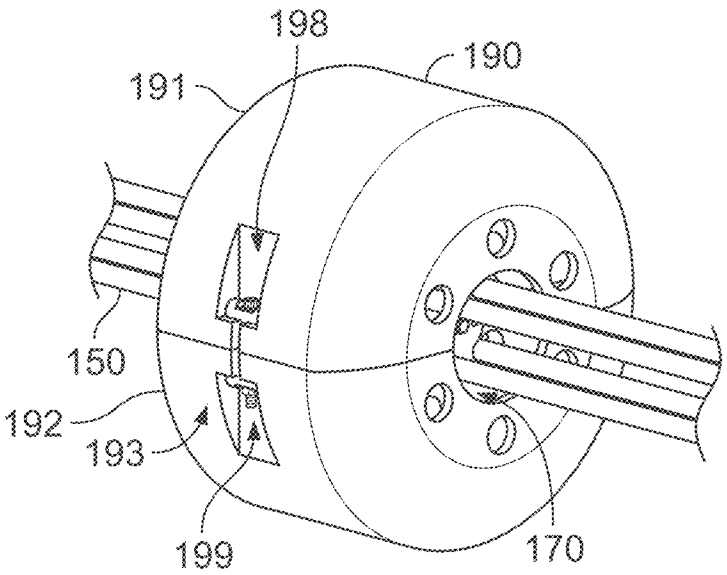
FIG. 6 depicts a perspective view of the elevator module shown in FIG. 4 in an assembled configuration and disposed about the fluid transfer conduits and separator assembly shown in FIG. 5.
Figure 5:
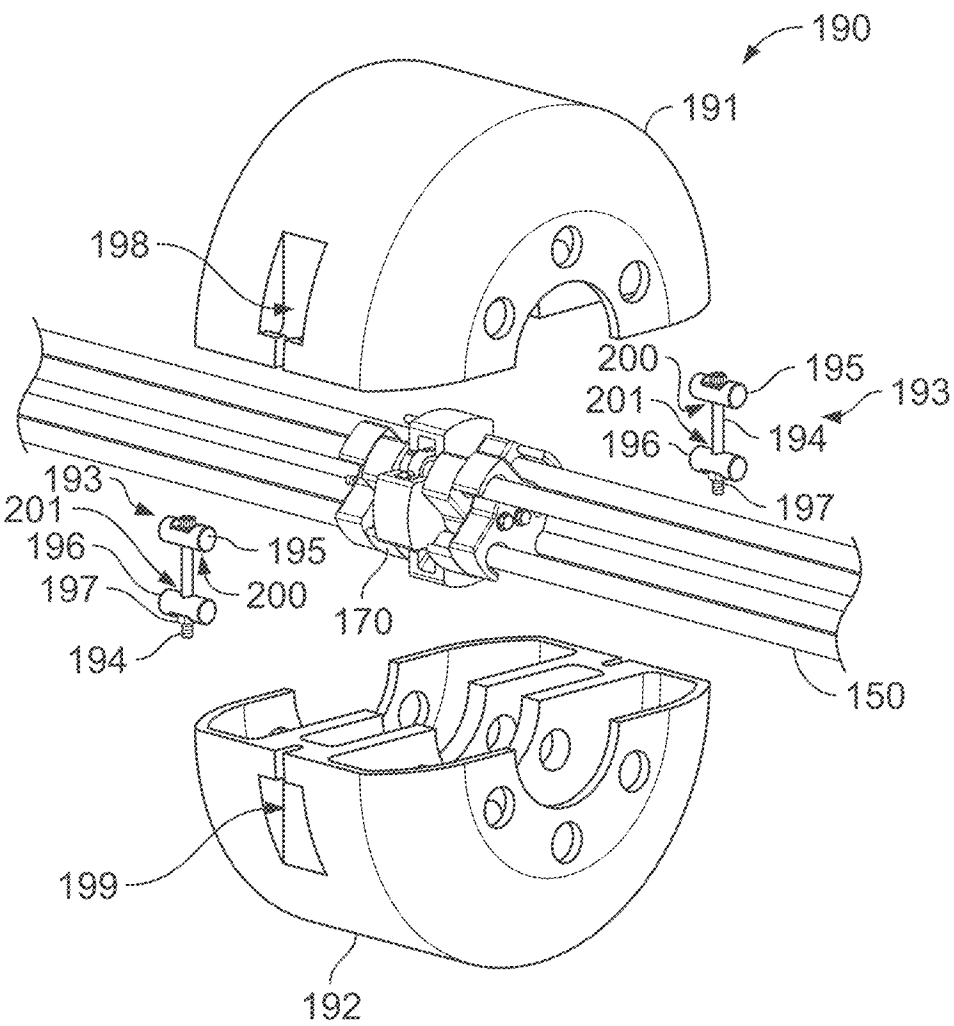
FIG. 5 depicts an exploded perspective view of an illustrative elevator module configured to be disposed about the separator assembly and fluid transfer conduits shown in FIGS. 1 and 2, according to one or more embodiments described.

FIG. 5 depicts an exploded perspective view of an illustrative elevator module 190 configured to be disposed about the separator assembly 170 and the fluid transfer conduits 150 shown in FIG. 2. FIG. 6 depicts a perspective view of the elevator module 190 in an assembled configuration and disposed about the separator assembly 170 shown in FIG. 2. In some embodiments, the elevator module 190 can include a first part 191 and a second part 192. In some embodiments, the first part 191 and the second part 192 can be configured to engage with or interface with one another. In some embodiments, the first part 191 and the second part 192 can be substantially identical or similar to one another. In other embodiments, the first part 191 and the second part 192 can be different from one another. In some embodiments, the first part 191 and the second part 192 can each be configured to be disposed on or otherwise about the separator assembly 170. In other embodiments, not shown, the elevator module 190 can be configured to be disposed about or coupled to the plurality of fluid transfer conduits 150.

In some embodiments, the first part 191 and the second part 192 can be coupled to or secured to one another via at least one draw bar assembly 193, two are shown. In some embodiments, the draw bar assembly 193 can include a threaded bar 194, a first end part 195, a second end part 196, and a nut 197. In some embodiments, the first end part 195 and the second end part 196 can be configured to be secured or disposed within a slot 198 of the first part 191 and a slot 199 of the second part 192, respectively, of the elevator module 190. In some embodiments the first end part 195 can define a bore 200 and can be secured to, formed around, threaded on or otherwise attached to the threaded bar 194. In some embodiments, the second end part 196 can define a bore 201 such that the second end part 196 can be disposed around the threaded bar 194 such that the second end part 196 is free to slide along and rotate about the threaded bar 194, and the nut 197 can be threaded onto the threaded bar 194. In some embodiments, when the first end part 195 is disposed within the slot 198 of the first part 191 of the elevator module 190 and the second end part 196 is disposed within the slot 199 of the second part 192 of the elevator module 190 the draw bar assembly 193 can pull the first part 191 and the second part 192 of the elevator module 190 toward one another to secure the elevator module 190 about the separator assembly 170 and about the plurality of fluid transfer conduits 150, as shown in FIG. 6. In some embodiments, the separator assembly 170 can be optional and, in such embodiments, the elevator module 190 can be disposed about the plurality of fluid transfer conduits 150.

In some embodiments, the elevator module first part 191 and the elevator module second part 192 can each be manufactured from a metallic material, a polymer or plastic material, a composite material, e.g., carbon fiber, or any other material that is suitable for subsea service. In some embodiments, the separator module 190 can be manufactured of a material such that the elevator modules 190 have a density that can be similar to the density of the body of water 9. In some embodiments, at least a portion of the elevator module 190 can have a density that is greater than the density of the body of water 9 such that at least a portion of the elevator modules 190 can sit or rest on a seabed 3 as shown in FIG. 1 when each elevator module 190 is disposed about a corresponding separator assembly 170 or disposed about the plurality of fluid transfer conduits 150. In some embodiments, the elevator module 190 can be configured to sit on or rest on the seabed 3 in a manner that elevates or maintains the plurality of fluid transfer conduits 150 above the seabed 3 when each elevator module 190 is disposed about a corresponding separator assembly 170 or disposed about the plurality of fluid transfer conduits 150.

In other embodiments, one or more of the elevator modules 190 can be configured to float above the seabed 3 when the one or more elevator modules 190 is disposed about a corresponding separator assembly 170 or disposed about the plurality of fluid transfer conduits 150. In such embodiments, the one or more elevator modules 190 can include a tether and an anchor (not shown) such that the elevator module(s) 190 can float above the seabed 3 at a predetermined or controlled elevation with respect to the seabed 3. Additionally, in such embodiments, the one or more elevator modules 190 can be formed of or from a buoyant material, for example a syntactic foam material. In some embodiments, when the elevator module(s) 190 is configured to float above the seabed 3, the tether (not shown) that can be used to secure the elevator module(s) 190 to the seabed 3 via the anchor (not shown) can be or can include, but are not limited to, a wire, a cable, a chain, an elongated relatively rigid member such as a rod or pipe, or any combination of suitable members. In some embodiments, when the elevator module(s) 190 is configured to float above the seabed 3, the anchor (not shown) that can be used to secure elevator module(s) 190 to the seabed 3 via the tether (not shown) can be or can include, but is not limited to, a weight, a driven pile, a suction pile, a threaded anchor bar, or any other suitable structure that can be secured to the seabed 3.

As shown in FIG. 1 and noted above, in some embodiments, the subsea fluid transfer system 100 can include at least one bend restrictor assembly 120, two are shown. In some embodiments, the bend restrictor assembly 120 can be configured as a plurality of articulated segments that can be connected to one another to limit or maintain a curvature or bending of a portion of the fluid transfer conduits 150 to within an specified or allowable limit. In some embodiments, the first end termination assembly 110 can have the bend restrictor assembly 120 attached thereto and/or in some embodiments the second end termination assembly 130 can have the bend restrictor assembly 120 attached thereto. In some embodiments, the bend restrictor assembly 120 can be or can include, but is not limited to, the bend limiting stiffener disclosed in U.S. Patent Application Publication No. US2012/0304447A1.

A process for transferring a fluid between the first subsea structure 1 and a second subsea structure 2 is also provided. In some embodiments, the process can include deploying the subsea fluid transfer system 100 toward the seabed 3 of the body of water 9. The mechanical connector first part 111 of the first end termination assembly 110 can be connected to the mechanical connector second part 5 disposed on the first subsea structure 1 such that the fluid coupler first part 112 of the first end termination assembly 110 can be in fluid communication with the fluid coupler second part 6 disposed on the first subsea structure 1. The mechanical connector first part 131 of the second end termination assembly 130 can be connected to the mechanical connector second part 7 disposed on the second subsea structure 2 such that the fluid coupler first part 132 of the second end termination assembly 130 can be in fluid communication with the fluid coupler second part 8 disposed on the second subsea structure 2.

The present disclosure further relates to any one or more of the following embodiments:

A1. A subsea fluid transfer system that can include: a first end termination assembly and a second end termination assembly, each comprising: a mechanical connector first part; a fluid coupler first part; and a fluid header conduit in fluid communication with the fluid coupler first part; a plurality of fluid transfer conduits each having a first end and a second end, wherein the first end of each fluid transfer conduit is in fluid communication with the fluid header conduit of the first end termination assembly, and the second end of each fluid transfer conduit is in fluid communication with the fluid header conduit of the second end termination assembly; and a plurality of separator assemblies, wherein each separator assembly defines a plurality of conduit bores therethrough, and each fluid transfer conduit is disposed within a corresponding conduit bore; wherein: the plurality of separator assemblies is distributed along a length of the plurality of fluid transfer conduits and maintains a separation distance between adjacent fluid transfer conduits.

A2. The subsea fluid transfer system of paragraph A1, further comprising a plurality of elevator modules, wherein each elevator module is configured to be disposed about a corresponding separator assembly.

A3. The subsea fluid transfer system of paragraph A1 or A2, wherein the plurality of elevator modules is configured to maintain at least a portion of the plurality of fluid transfer conduits at an elevation above a seabed.

A4. The subsea fluid transfer system of any one of paragraphs A1 to A3, wherein: the mechanical connector first part of the first end termination assembly is configured to connect to a corresponding mechanical connector second part disposed on a first subsea structure, the mechanical connector first part of the second end termination assembly is configured to connect to a corresponding mechanical connector second part disposed on a second subsea structure, the fluid coupler first part of the first end termination assembly is configured to fluidly connect to a corresponding fluid coupler second part disposed on the first subsea structure, and the fluid coupler first part of the second end termination assembly is configured to fluidly connect to a corresponding fluid coupler second part disposed on the second subsea structure.

A5. The subsea fluid transfer system of any one of paragraphs A1 to A4, further comprising a bend restrictor assembly configured to limit a curvature of a portion of the plurality of fluid transfer conduits to within a predetermined limit.

A6. The subsea fluid transfer system of any one of paragraphs A1 to A5, wherein the bend restrictor assembly is configured to be connected to the first end termination assembly or the second end termination assembly.

A7. The subsea fluid transfer system of any one of paragraphs A1 to A6, wherein at least one of the plurality of fluid transfer conduits comprises a metallic tube.

A8. The subsea fluid transfer system of any one of paragraphs A1 to A7, wherein the plurality of fluid transfer conduits is free from an outer sheath.

A9. The subsea fluid transfer system of any one of paragraphs A1 to A8, wherein the plurality of fluid transfer conduits is configured to transfer a fluid between a first subsea structure and a second subsea structure.

A10. The subsea fluid transfer system of any one of paragraphs A1 to A9, wherein each of the plurality of fluid transfer conduits is configured to be in direct contact with a body of water, the system is configured to transfer a heat energy of the fluid through a wall of each fluid transfer conduit to the body of water when the fluid is being transferred between the first subsea structure and the second subsea structure.

A11. The subsea fluid transfer system of any one of paragraphs A1 to A10, wherein each elevator module comprises a first part and a second part configured to engage with one another, and at least one draw bar assembly configured to secure the first part and the second part of each elevator module to one another and about a corresponding separator assembly.

A12. The subsea fluid transfer system of any one of paragraphs A1 to A11, wherein: each elevator module is formed of a buoyant material, each elevator module further comprises an anchor and a tether, and at least a portion of the plurality of transfer conduits floats above a seabed of a body of water.

A13. The subsea fluid transfer system of any one of paragraphs A1 to A2, wherein the first subsea structure is a subsea Christmas tree and the second subsea structure is a subsea manifold.

B1. A process for transferring a fluid between a first subsea structure and a second subsea structure, that can include: deploying a subsea fluid transfer system toward a seabed of a body of water, wherein the subsea fluid transfer system comprises: a first end termination assembly and a second end termination assembly each comprising a mechanical connector first part, a fluid coupler first part, and a fluid header conduit in fluid communication with the fluid coupler first part; a plurality of fluid transfer conduits each having a first end and a second end, wherein the first end of each fluid transfer conduit is in fluid communication with the fluid header conduit of the first end termination assembly, and the second end of each fluid transfer conduit is in fluid communication with the fluid header conduit of the second end termination assembly; and a plurality of separator assemblies, wherein each separator assembly defines a plurality of conduit bores therethrough, and each fluid transfer conduit is disposed within a corresponding conduit bore; wherein the plurality of separator assemblies is distributed along a length of the plurality of fluid transfer conduits and maintains a separation distance between adjacent fluid transfer conduits; connecting the mechanical connector first part of the first end termination assembly to a mechanical connector second part disposed on the first subsea structure such that the fluid coupler first part of the first end termination assembly is in fluid communication with the fluid coupler second part disposed on the first subsea structure; and connecting the mechanical connector first part of the second end termination assembly to a mechanical connector second part disposed on the second subsea structure such that the fluid coupler first part of the second end termination assembly is in fluid communication with the fluid coupler second part disposed on the second subsea structure.

B2. The process of paragraph B1, wherein the subsea fluid transfer system further comprises a bend restrictor assembly connected to the first end termination assembly or the second end termination assembly, wherein the bend restrictor assembly is configured to limit a curvature of a portion of the plurality of fluid transfer conduits to within a specified allowable limit.

B3. The process of paragraph B1 or B2, further comprising a plurality of elevator modules wherein each elevator module is disposed about a corresponding separator assembly.

B4. The process of any one of paragraphs B1 to B3, wherein the plurality of elevator modules is configured to maintain the plurality of fluid transfer conduits at an elevation above a seabed.

B5. The process of any one of paragraphs B1 to B4, wherein at least one of the plurality of fluid transfer conduits comprises a metallic tube.

B6. The process of any one of paragraphs B1 to B5, wherein the system is configured to transfer a heat energy of the fluid through a wall of each fluid transfer conduit to the body of water when the fluid is transferred between the first subsea structure and the second subsea structure.

C1. A subsea fluid transfer system that can include: a first end termination assembly and a second end termination assembly, each comprising: a mechanical connector first part; a fluid coupler first part; and a fluid header conduit in fluid communication with the fluid coupler first part; a plurality of fluid transfer conduits each having a first end and a second end, wherein the first end of each fluid transfer conduit is in fluid communication with the fluid header conduit of the first end termination assembly, and the second end of each fluid transfer conduit is in fluid communication with the fluid header conduit of the second end termination assembly; a plurality of separator assemblies, wherein each separator assembly defines a plurality of conduit bores therethrough, and each fluid transfer conduit is disposed within a corresponding conduit bore; a plurality of elevator modules wherein each elevator module is disposed about a corresponding separator assembly; a first bend restrictor assembly connected to the first end termination assembly configured to limit a curvature of a portion of the plurality of fluid transfer conduits to within a specified allowable limit; and a second bend restrictor assembly connected to the second end termination assembly configured to limit a curvature of a portion of the plurality of fluid transfer conduits to within a specified allowable limit, wherein: the mechanical connector first part of the first end termination assembly is configured to connect to a corresponding mechanical connector second part disposed on a first subsea structure, the mechanical connector first part of the second end termination assembly is configured to connect to a corresponding mechanical connector second part disposed on a second subsea structure, the fluid coupler first part of the first end termination assembly is configured to fluidly connect to a corresponding fluid coupler second part disposed on the first subsea structure, the fluid coupler first part of the second end termination assembly is configured to fluidly connect to a corresponding fluid coupler second part disposed on the second subsea structure, the plurality of separator assemblies is distributed along a length of the plurality of fluid transfer conduits and configured to maintain a separation distance between adjacent fluid transfer conduits, and the plurality of elevator modules is configured to maintain the plurality of fluid transfer conduits at an elevation above a seabed.

D1. A subsea transfer system, comprising: a first end termination assembly and a second end termination assembly, each comprising: a mechanical connector first part; a coupler first part; and a header conduit in communication with the coupler first part; a plurality of conduits or cables each having a first end and a second end, wherein the first end of each conduit or cable is in communication with the header conduit of the first end termination assembly, and the second end of each transfer conduit is in fluid communication with the header conduit of the second end termination assembly; and a plurality of separator assemblies, wherein each separator assembly defines a plurality of conduit or cable bores therethrough, and each transfer conduit is disposed within a corresponding conduit or cable bore; wherein: the plurality of separator assemblies is distributed along a length of the plurality of transfer conduits and maintains a separation distance between adjacent transfer conduits.

D2. The subsea transfer system according to paragraph D1, wherein the system comprises a plurality of electric conduits or cables configured to transmit electricity therethrough.

D3. The subsea transfer system according to paragraph D1, wherein the system comprises a plurality of fiberoptic conduits or cables configured to transmit electromagnetic radiation therethrough.

D4. The subsea transfer system according to paragraph D1, wherein the system comprises a plurality of fiberoptic conduits or cables configured to transmit light therethrough.

E1. A subsea transfer system, comprising: a first end termination assembly and a second end termination assembly, each comprising: a mechanical connector first part; a coupler first part; and a header conduit in communication with the coupler first part; a plurality of transfer conduits each having a first end and a second end, wherein the first end of each transfer conduit is in communication with the header conduit of the first end termination assembly, and the second end of each transfer conduit is in fluid communication with the header conduit of the second end termination assembly; and a plurality of separator assemblies, wherein each separator assembly defines a plurality of conduit bores therethrough, and each transfer conduit is disposed within a corresponding conduit bore; wherein: the plurality of separator assemblies is distributed along a length of the plurality of transfer conduits and maintains a separation distance between adjacent transfer conduits.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should, therefore, be expressly understood that such modifications and adaptations may be devised without departing from the basic scope thereof, and the scope thereof can be determined by the claims that follow.

What is claimed is:

1. A subsea fluid transfer system, comprising:

a first end termination assembly and a second end termination assembly, each comprising:

a mechanical connector first part;

a fluid coupler first part; and a fluid header conduit in fluid communication with the fluid coupler first part;

a plurality of fluid transfer conduits each having a first end and a second end, wherein the first end of each fluid transfer conduit is in fluid communication with the fluid header conduit of the first end termination assembly, and the second end of each fluid transfer conduit is in fluid communication with the fluid header conduit of the second end termination assembly; and a plurality of separator assemblies, wherein each separator assembly defines a plurality of conduit bores therethrough, and each fluid transfer conduit is disposed within a corresponding conduit bore; wherein:

the plurality of separator assemblies is distributed along a length of the plurality of fluid transfer conduits and maintains a separation distance between adjacent fluid transfer conduits.

2. The subsea fluid transfer system of claim 1, further comprising a plurality of elevator modules, wherein each elevator module is configured to be disposed about a corresponding separator assembly.

3. The subsea fluid transfer system of claim 2, wherein the plurality of elevator modules is configured to maintain at least a portion of the plurality of fluid transfer conduits at an elevation above a seabed.

4. The subsea fluid transfer system of claim 3, wherein:

the mechanical connector first part of the first end termination assembly is configured to connect to a corresponding mechanical connector second part disposed on a first subsea structure, the mechanical connector first part of the second end termination assembly is configured to connect to a corresponding mechanical connector second part disposed on a second subsea structure, the fluid coupler first part of the first end termination assembly is configured to fluidly connect to a corresponding fluid coupler second part disposed on the first subsea structure, and the fluid coupler first part of the second end termination assembly is configured to fluidly connect to a corresponding fluid coupler second part disposed on the second subsea structure.

5. The subsea fluid transfer system of claim 4, further comprising a bend restrictor assembly configured to limit a curvature of a portion of the plurality of fluid transfer conduits to within a predetermined limit, wherein the bend restrictor assembly is configured to be connected to the first end termination assembly or the second end termination assembly.

6. The subsea fluid transfer system of claim 2, wherein each elevator module comprises a first part and a second part configured to engage with one another about a corresponding separator assembly.

7. The subsea fluid transfer system of claim 1, wherein the plurality of fluid transfer conduits is free from an outer sheath.

8. The subsea fluid transfer system of claim 7, wherein the plurality of fluid transfer conduits is configured to transfer a fluid between a first subsea structure and a second subsea structure.

9. The subsea fluid transfer system of claim 8, wherein:

each of the plurality of fluid transfer conduits is configured to be in direct contact with a body of water, and the system is configured to transfer heat from the fluid through a wall of each fluid transfer conduit to the body of water when the fluid is being transferred between the first subsea structure and the second subsea structure.

10. The subsea fluid transfer system of claim 7, wherein:

each elevator module is formed of a buoyant material, each elevator module further comprises an anchor and a tether, and at least a portion of the plurality of transfer conduits floats above a seabed of a body of water.

11. The subsea fluid transfer system of claim 2, wherein each elevator module comprises a first part and a second part configured to engage with one another, and at least one draw bar assembly configured to secure the first part and the second part of each elevator module to one another and about a corresponding separator assembly.

12. The subsea fluid transfer assembly of claim 1, wherein the plurality of separator assemblies is distributed along a length of the plurality of fluid transfer conduits between the first end termination assembly and the second end termination assembly.

13. The subsea fluid transfer assembly of claim 1, wherein:

the subsea fluid transfer system comprises a first bend restrictor assembly configured to be connected to the first end termination assembly, the subsea fluid transfer system comprises a second bend restrictor assembly configured to connected to the second end termination assembly, and the plurality of separator assemblies is distributed along a length of the plurality of fluid transfer conduits between the first bend restrictor assembly and the second bend restrictor assembly.

14. The subsea fluid transfer assembly of claim 1, wherein:

the fluid header conduit of the first end termination assembly defines a bore therethrough, the fluid header conduit of the second end termination assembly defines a bore therethrough, the first end of each fluid transfer conduit in the plurality of fluid transfer conduits is configured to be in fluid communication with the bore defined by the fluid header conduit of the first end termination assembly, and the second end of each fluid transfer conduit in the plurality of fluid transfer conduits is configured to be in fluid communication with the bore defined by the fluid header conduit of the second end termination assembly.

15. A process for transferring a fluid between a first subsea structure and a second subsea structure, comprising:

deploying a subsea fluid transfer system toward a seabed of a body of water, wherein the subsea fluid transfer system comprises:

a first end termination assembly and a second end termination assembly each comprising a mechanical connector first part, a fluid coupler first part, and a fluid header conduit in fluid communication with the fluid coupler first part;

a plurality of fluid transfer conduits each having a first end and a second end, wherein the first end of each fluid transfer conduit is in fluid communication with the fluid header conduit of the first end termination assembly, and the second end of each fluid transfer conduit is in fluid communication with the fluid header conduit of the second end termination assembly; and a plurality of separator assemblies, wherein each separator assembly defines a plurality of conduit bores therethrough, and each fluid transfer conduit is disposed within a corresponding conduit bore; wherein the plurality of separator assemblies is distributed along a length of the plurality of fluid transfer conduits and maintains a separation distance between adjacent fluid transfer conduits;

connecting the mechanical connector first part of the first end termination assembly to a mechanical connector second part disposed on the first subsea structure such that the fluid coupler first part of the first end termination assembly is in fluid communication with the fluid coupler second part disposed on the first subsea structure; and connecting the mechanical connector first part of the second end termination assembly to a mechanical connector second part disposed on the second subsea structure such that the fluid coupler first part of the second end termination assembly is in fluid communication with the fluid coupler second part disposed on the second subsea structure.

16. The process of claim 15, wherein the subsea fluid transfer system further comprises a bend restrictor assembly connected to the first end termination assembly or the second end termination assembly, wherein the bend restrictor assembly is configured to limit a curvature of a portion of the plurality of fluid transfer conduits to within a specified allowable limit.

17. The process of claim 16, further comprising a plurality of elevator modules wherein each elevator module is disposed about a corresponding separator assembly.

18. The process of claim 17, wherein the plurality of elevator modules is configured to maintain the plurality of fluid transfer conduits at an elevation above a seabed.

19. The process of claim 18, wherein at least one of the plurality of fluid transfer conduits comprises a metallic tube.

20. The process of claim 19, wherein the system is configured to transfer a heat energy of the fluid through a wall of each fluid transfer conduit to the body of water when the fluid is transferred between the first subsea structure and the second subsea structure.

21. The subsea fluid transfer assembly of claim 15, wherein the plurality of separator assemblies is distributed along a length of the plurality of fluid transfer conduits between the first end termination assembly and the second end termination assembly.

22. A subsea fluid transfer system, comprising:

a first end termination assembly and a second end termination assembly, each comprising:

a mechanical connector first part;

a fluid coupler first part; and a fluid header conduit in fluid communication with the fluid coupler first part;

a plurality of fluid transfer conduits each having a first end and a second end, wherein the first end of each fluid transfer conduit is in fluid communication with the fluid header conduit of the first end termination assembly, and the second end of each fluid transfer conduit is in fluid communication with the fluid header conduit of the second end termination assembly;

a plurality of separator assemblies, wherein each separator assembly defines a plurality of conduit bores therethrough, and each fluid transfer conduit is disposed within a corresponding conduit bore;

a plurality of elevator modules wherein each elevator module is disposed about a corresponding separator assembly;

a first bend restrictor assembly connected to the first end termination assembly configured to limit a curvature of a portion of the plurality of fluid transfer conduits to within a specified allowable limit; and a second bend restrictor assembly connected to the second end termination assembly configured to limit a curvature of a portion of the plurality of fluid transfer conduits to within a specified allowable limit, wherein:

the mechanical connector first part of the first end termination assembly is configured to connect to a corresponding mechanical connector second part disposed on a first subsea structure, the mechanical connector first part of the second end termination assembly is configured to connect to a corresponding mechanical connector second part disposed on a second subsea structure, the fluid coupler first part of the first end termination assembly is configured to fluidly connect to a corresponding fluid coupler second part disposed on the first subsea structure, the fluid coupler first part of the second end termination assembly is configured to fluidly connect to a corresponding fluid coupler second part disposed on the second subsea structure, the plurality of separator assemblies is distributed along a length of the plurality of fluid transfer conduits and configured to maintain a separation distance between adjacent fluid transfer conduits, and the plurality of elevator modules is configured to maintain the plurality of fluid transfer conduits at an elevation above a seabed.

23. The subsea fluid transfer assembly of claim 22, wherein the plurality of separator assemblies is distributed along a length of the plurality of fluid transfer conduits between the first bend restrictor assembly and the second bend restrictor assembly.

* * * * *